US005398846A

United States Patent [19]

Corba et al.

[11] Patent Number: 5,398,846

[45] Date of Patent: Mar. 21, 1995

[54] ASSEMBLY FOR SIMULTANEOUS DISPENSING OF MULTIPLE FLUIDS

[75] Inventors: Robert E. Corba, Caledonia; Allen D. Miller, Mt. Pleasant; D. James Musiel, Racine; Frederick H. Martin, Mt. Pleasant; Stephanie Bohrer, Racine, all of Wis.; Jack E. Miller, Houston, Tex.

[73] Assignee: S. C. Johnson & Son, Inc., Racine, Wis.

[21] Appl. No.: 109,872

[22] Filed: Aug. 20, 1993

[51] Int. Cl.[6] ..... B67D 5/60

[52] U.S. Cl. ..... 222/1; 222/145; 222/484

[58] Field of Search ..... 237/304; 222/136, 144.5, 222/145, 383, 375, 376, 481.5–484

[56] References Cited

U.S. PATENT DOCUMENTS

| | | | |
|---|---|---|---|
| 1,134,098 | 4/1915 | Block | 239/305 |
| 3,104,039 | 9/1963 | Dike | 222/484 |
| 3,760,986 | 9/1973 | Castner | 222/137 |
| 3,782,610 | 1/1974 | Gilbert | 222/484 |
| 3,786,963 | 1/1974 | Metzler | 222/136 |
| 3,850,346 | 11/1974 | Richardson et al. | 222/145 |
| 4,355,739 | 10/1982 | Vierkotter | 222/134 |
| 4,549,674 | 10/1985 | Alticosalian | 222/144.5 |
| 4,826,048 | 5/1989 | Skorka | 222/137 |
| 4,925,066 | 5/1990 | Rosenbaum | 222/192 |
| 5,009,342 | 4/1991 | Lawrence | 222/136 |
| 5,152,461 | 10/1992 | Proctor | 222/136 |
| 5,192,007 | 3/1993 | Blomquist | 222/383 |

*Primary Examiner*—Andres Kashnikow
*Assistant Examiner*—Philippe Derakshani

[57] ABSTRACT

An apparatus for the simultaneous dispensing of fluids from multiple containers in a pre-determined ratio. The apparatus has a pump, at least two fluid containers, a fluid transfer device including dip tubes to transfer fluid from the containers to the pump, a venting system that prevents the creation of pressure differentials between the containers, and a device to open and close the dip tubes so leakage from the containers can be prevented.

51 Claims, 5 Drawing Sheets

ASSEMBLY FOR SIMULTANEOUS DISPENSING OF MULTIPLE FLUIDS

FIELD OF INVENTION

The present invention relates to the field of fluid dispensers and especially to a leakage resistant fluid dispensing assembly that has multiple containers intended to hold different types of fluids which are, by a single pumping and transfer system, simultaneously and in a balanced manner drawn from the containers and dispensed through a single nozzle.

BACKGROUND ART

Containers that can simultaneously dispense more than one sort of fluid are desirable, especially when the fluids to be dispensed contain some active ingredients that are incompatible when these ingredients are mixed together in a single solution, yet it is desired to dispense both fluids with their active ingredients simultaneously. Several problems have consistently shown up with such dispensing systems. Venting of the containers, without allowing leakage of the fluid contents of a container, has been a consistent and recognized problem. An unaddressed problem with such a dispensing system is achieving and maintaining constant flow rates from the different containers (the result of unequal flow being the exhaustion of one container while another still contains fluid) so that the fluids dispensed are dispersed in an equal (or pre-determinedly different) ratio.

The importance of dispensing certain fluids from different containers for a particular effect or use has long been recognized. U.S. Pat. No. 1,134,098, to Bloch, "Perfume Sprayer" discloses a direct-action compression pump for spraying two perfumes simultaneously from two containers through two nozzles. The patent states that this system can produce fragrances not possible with single solution perfumes. This sprayer has venting of a different sort: air is compressed by the pump and passes through "vent" holes into the containers. The pressure created drives liquid up the dip tube and out into the atmosphere.

Various types of devices exist that allow two fluids to be dispensed from a single dispenser—either sequentially or simultaneously. U.S. Pat. No. 4,925,066 to Rosenbaum, entitled "Combined Sprayer and Refill Container," provides for a second container which attaches to a single container dispensing assembly. The auxiliary container is intended to hold a refill concentrate for replenishing the primary spray container. The patent is silent on the need for venting.

U.S. Pat. No. 5,152,461 to Proctor, "Hand-operated Spray With Multiple Fluid Containers" discloses a sprayer which has two fluid containers from which fluids are drawn through dip tubes up into a single trigger-activated pump, inside of which the fluids are mixed and from which they are dispensed through a single nozzle. The containers are individually vented through vent holes having one-way flexible valving mechanisms.

U.S. Pat. No. 3,786,963 to Metzler III, "Apparatus For Dispensing Mixed Components" discloses a dispensing apparatus having two dip tubes which are of unequal size and enter a fluid transfer channel below a trigger activated pump at spaced-apart locations. The patent is silent on the reasons for these differences. The apparatus has a vent hole opening into the pump chamber but the patent is silent on venting into the containers which would be used with the apparatus.

U.S. Pat. No. 5,009,342 to Lawrence et al, "Dual Liquid Spraying Assembly" discloses an assembly for dispensing different liquids made up of two or more liquid compartments, a spray pump dispenser, means for transferring the liquid to the pump, and a valve assembly for selecting one or another of the liquids or a mixture of the two for dispensing. The valve assembly is made up of to two major components; a central part having a liquid channel that can connect either or both of the inlet openings into the liquid compartment with the outlet into the pump and a control part for positioning that central part apparatus. Mixtures are created by the relative degree of openness of the inlet openings much in the way different degrees of warm water is produced by varying relative openings of hot and cold water faucets. The patent is silent on the need for venting.

U.S. Pat. No. 4,355,739 to Vierkötter "Liquid Storage Container" discloses a liquid container having two separate chambers each having a take-up tube that leads to a fluid transfer channel which is connected to a single spray pump. A moveable selector can be rotated to vary the size of the passageways between the take-up tubes and the fluid transfer channel and this varies the ratio of the liquids dispensed. The take-up tubes have one way valves to prevent reflux and the venting of the containers occurs through the connection area between the pump housing and the top of the container.

The need to vent a rigid container from which fluid is being dispensed is known. One example is U.S. Pat. No. 5,192,007 to Blomquist "Valve Assembly for Inverted Dispensing From a Container with a Pump" discloses a valving mechanism for dispensing a liquid from a single container, the mechanism having a vent passage and a liquid passage, both of which are provided with ball check valves. The vent valve is closed by the ball when the container is inverted during dispensing. However, when sufficient negative pressure differential is developed within the emptying container, the ball unseats itself and allows ambient air to enter the container.

However, the prior art has not recognized the necessity of a precise balancing of the venting of the containers for a dispensing system made up of multiple containers with a single pump and dispensing nozzle, to consistently dispense the desired ratio of fluids.

Venting a single container is a simple matter, and even if the venting system is not properly designed, causes no worse problems than inefficient or irregular pumping of fluid from the container. But when a single pump is drawing fluids from more than one container, unequal venting causes serious functional problems.

As stated before, the reason for having multiple container systems is to allow simultaneous dispensing of two (or more) distinct fluids. One fluid might be water and the other a concentrate (the use envisioned by U.S. Pat. No. 5,152,461). Or one container might hold a fluid with an active ingredient which the fluid in the second container would deactivate. Examples of such pairs of fluids could be a cleaning composition and a bleach, or a pair of stain removing compositions, one an aqueous composition and the other a high-solvent level enzyme containing composition.

Whatever the pair of fluids are, they are intended to be dispensed simultaneously and in a fixed ratio to each other (the ratio being set either by the design of the system itself, as discussed below or by some sort of flow adjustment means (U.S. Pat. No. 5,152,461 discloses one type of variable flow control mechanism)).

As a pump draws fluid from a rigid container, the fluid drawn from that container must be replaced by air (venting) for pumping to continue. (Non-rigid containers simply collapse as fluid is drawn from them). When a single pump draws fluids from two containers simultaneously, and especially when the fluids being pumped from the different containers have different vapor pressures, the degree and speed of venting of the two containers must be almost exactly the same, or a pressure differential is created between the two containers. This pressure differential causes fluid to be pumped from the two containers at different rates, which tends to exacerbate the pressure differential. It has been found that the "replacement" speed of the venting of the container must be almost instantaneous to avoid the creation of this pressure differential/ratio problem. The result of this is that the desired ratio of the two fluids is not dispensed.

Manually operable pumps for use by individuals in any location are necessarily small and light—and therefore have low displacement capacities and low pressure differentials. Available trigger operated spray pumps have been found to pull pressure differentials below approximately 8 psi (550 millibars).

When fluids are dispensed from the fluid containers, a small pressure differential can form without unimpeded and instantaneous venting of the containers in a multiple component dispensing system, making the venting a critical factor. With larger capacity higher pressure differential pumps, flapper valves, ball check valves, duck bill valves or the like covering the vent holes would pop open promptly in response to the action of the pump which created the pressure differential pull. But small pressure differentials mean that small differences in the behavior of the materials or components of a venting system can produce unbalanced venting. For example, deformable materials for use in components of items for mass consumer use are neither precision formulated nor configured. Thus, one flapper valve of a pair might be more or less rigid than the other, and one would flex open in response to a small pressure differential pull before the other, creating unequal venting with the problems described before.

The obvious solution to instantaneous venting is simply to have permanently open vent holes into the fluid containers. This, however, is not a functionally acceptable solution for such a dispensing system, for the simple reason that such vent holes would also be leak holes. Fluid leakage through open vent holes would occur when such containers are inadvertently inverted or knocked on their sides. Leakage would also occur if such containers were transported in a low-pressure environment (e.g. the cargo section of an airplane). Additionally, permanently open vent holes would allow vaporization of volatile compounds from within a fluid container. Thus, some means of closing the vent holes is necessary, but the closure mechanism must not in any way impede the flow of air into the container.

While consistency of dispensing is controlled by the venting mechanism of the dispensing apparatus, the ratio of the liquids to be mixed and then dispensed is controlled by the intentional balancing of several interrelated factors: the length and diameters of the dip tubes, and the viscosities and specific gravities of the fluids to be dispersed, as well as the pumping capacity of the pump.

Another thing that must be prevented for consistent dispensing of two distinct fluids is excessive commingling of the fluids before they are dispensed. This can happen either because the two fluids are brought together in a larger than necessary fluid transfer channel or because a pressure differential created between the containers will cause siphoning between the containers. To prevent this, some sort of balanced one-way valving system must be incorporated into the fluid system of the assembly.

Accordingly, it is an object of the invention to provide a multiple container dispensing assembly having multiple fluid containers connected to a single pump and nozzle dispensing system which allows balanced pumping of fluid from each container so that the desired mixture of fluids dispensed is always maintained.

It is a further object of this invention to provide such a dispensing system that achieves that stable ratio of dispensing fluids by means of a venting system that allows simultaneous and instantaneous, non-impeded venting of the containers to the ambient atmosphere.

Another object of the invention is to provide such a dispensing system that can be transported and stored without danger of leakage or vaporization of its contents.

Yet another object of the invention is to provide such a dispensing system that will disperse a mixture of two or more different fluids in a specific and pre-set ratio.

A further object of the invention is to provide such a dispensing system that will prevent premature commingling or siphoning of the distinct fluids to be dispensed.

SUMMARY OF THE INVENTION

The present invention is a dispensing system that allows two or more different fluids to be drawn from their respective containers and dispensed simultaneously from a single nozzle. The pumping mechanism of the system has a unique venting system that allows air to instantaneously enter the two containers to equalize the pressure when fluid is pumped from those containers, a mechanism to allow the venting system to be closed off to prevent fluid leakage, and means for preventing commingling or siphoning of the fluids.

BEST MODE FOR CARRYING OUT THE INVENTION

In the detailed descriptions of the drawings of the best mode for carrying out the invention, like reference numbers are used on the different figures to refer to like parts. Parts that are functionally similar but differ slightly in structure and/or location are indicated with like reference numbers followed by lower case letters.

Figure 1:
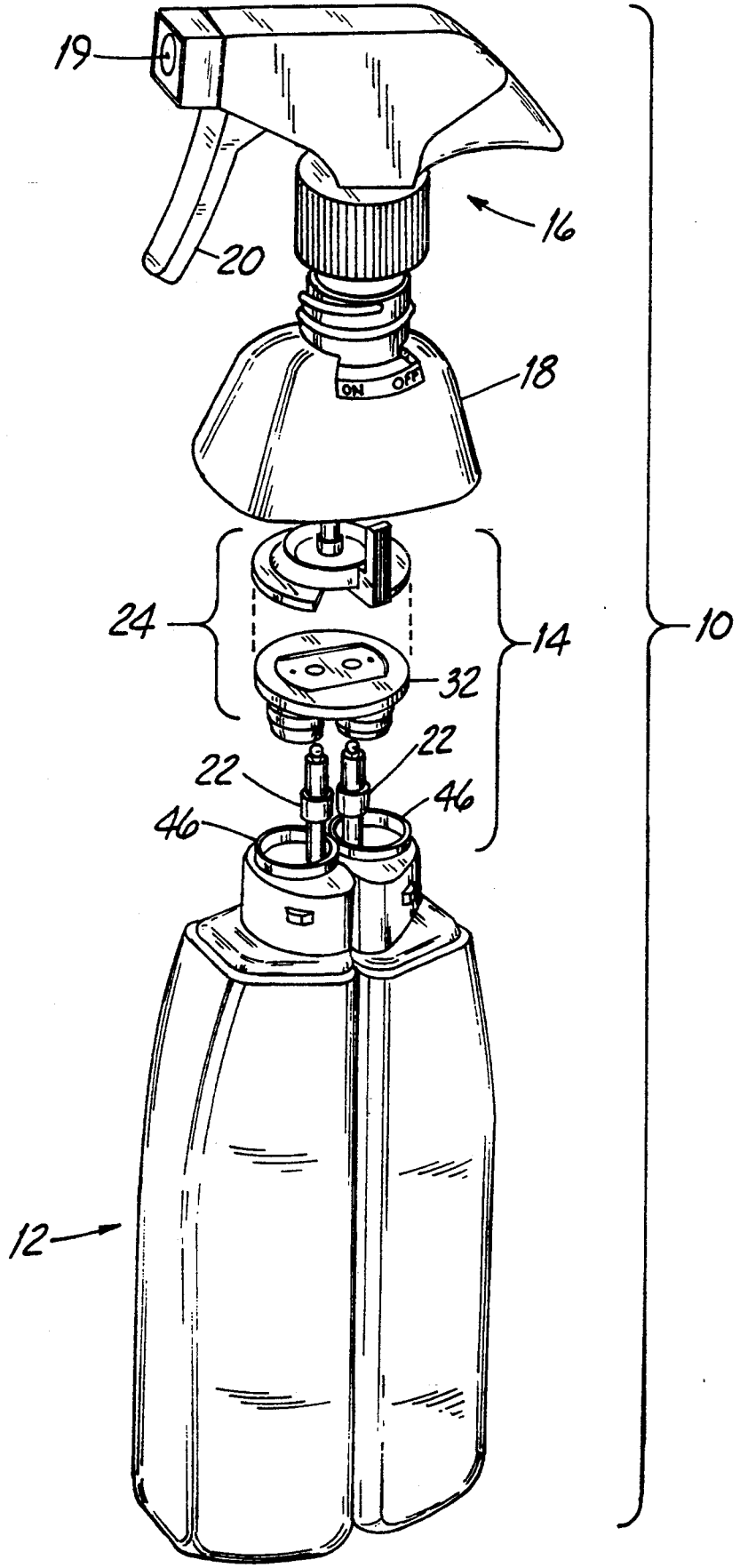
FIG. 1 is an exploded perspective of the dispensing assembly, showing the major components of that assembly.

As FIG. 1 shows, fluid dispensing assembly 10 is made up of three main components: fluid containers 12, fluid transfer system 14 and pump 16. Shroud 18 connects pump 16 to fluid transfer system 14 and fluid containers 12 connect with fluid transfer system 14. Pump 16, which in this embodiment has dispensing outlet 19 and trigger 20, may be any of the manually operated, relatively low displacement types (approx. 0.2 to 1.5 ml) available. Fluid transfer system 14 is actually two fluid transfer systems although they co-exist in the same structure and act simultaneously. Simultaneous action is essential for pumping. Co-existence in the same structure is not, for the venting system could be separated from the system that controls fluid flow between the containers and the pump. One system, which transfers fluid from within fluid containers 12 into pump 16 for dispensing from dispensing outlet 19, is essentially made up of dip tubes 22 and fluid control mechanism 24. The other system controls the venting of containers 12. This system is essentially made up of the various vent holes, which will be discussed below, and fluid control mechanism 24 which functions to either cover or uncover the vent and dip tube holes.

Figure 2:
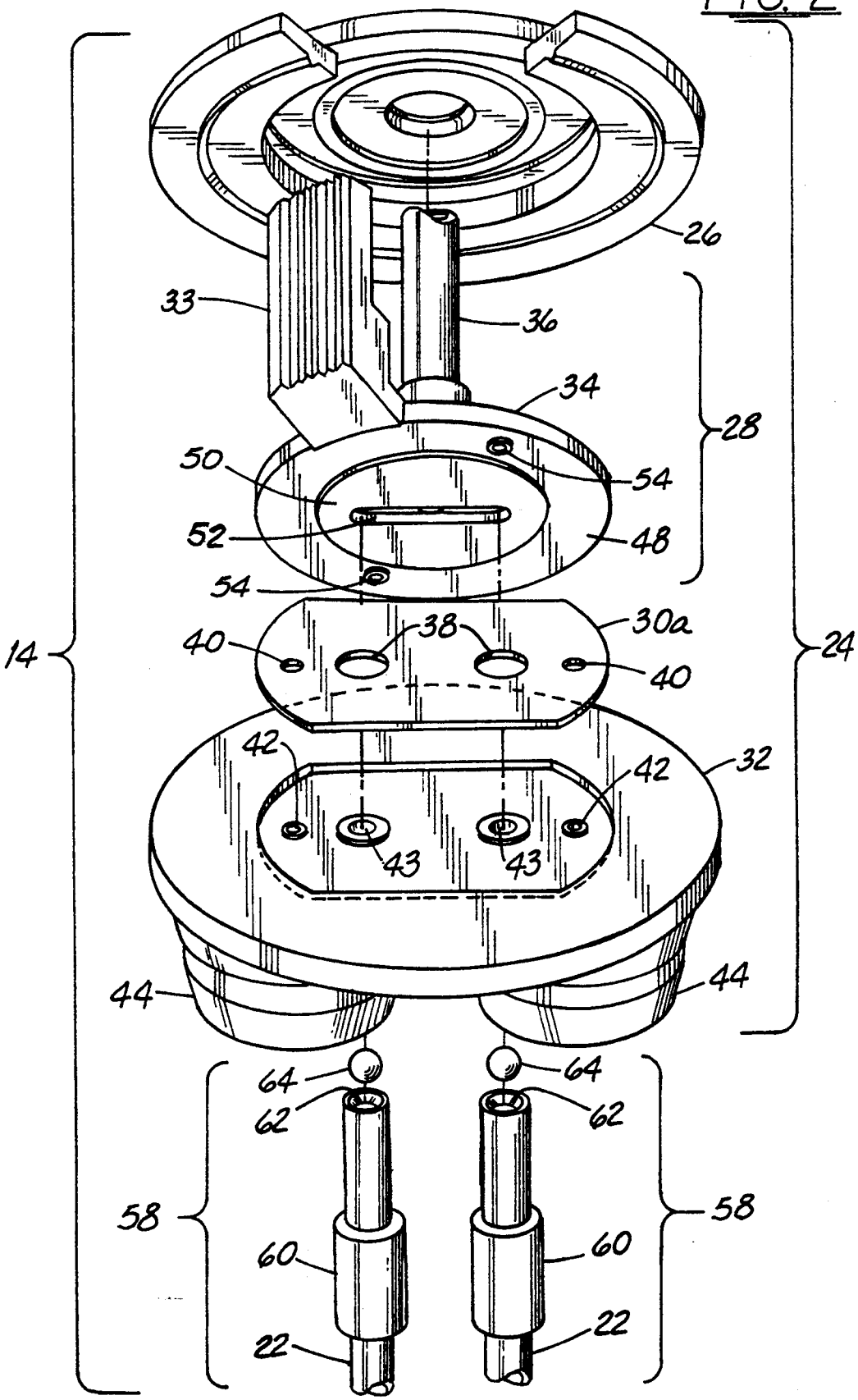
FIG. 2 is an exploded and rotated perspective of the fluid transfer system of the dispensing assembly, showing a first embodiment of the dip tube closure means, the dip tubes and vent holes operationally opened ("uncovered") by their respective closure means.
Figure 3:
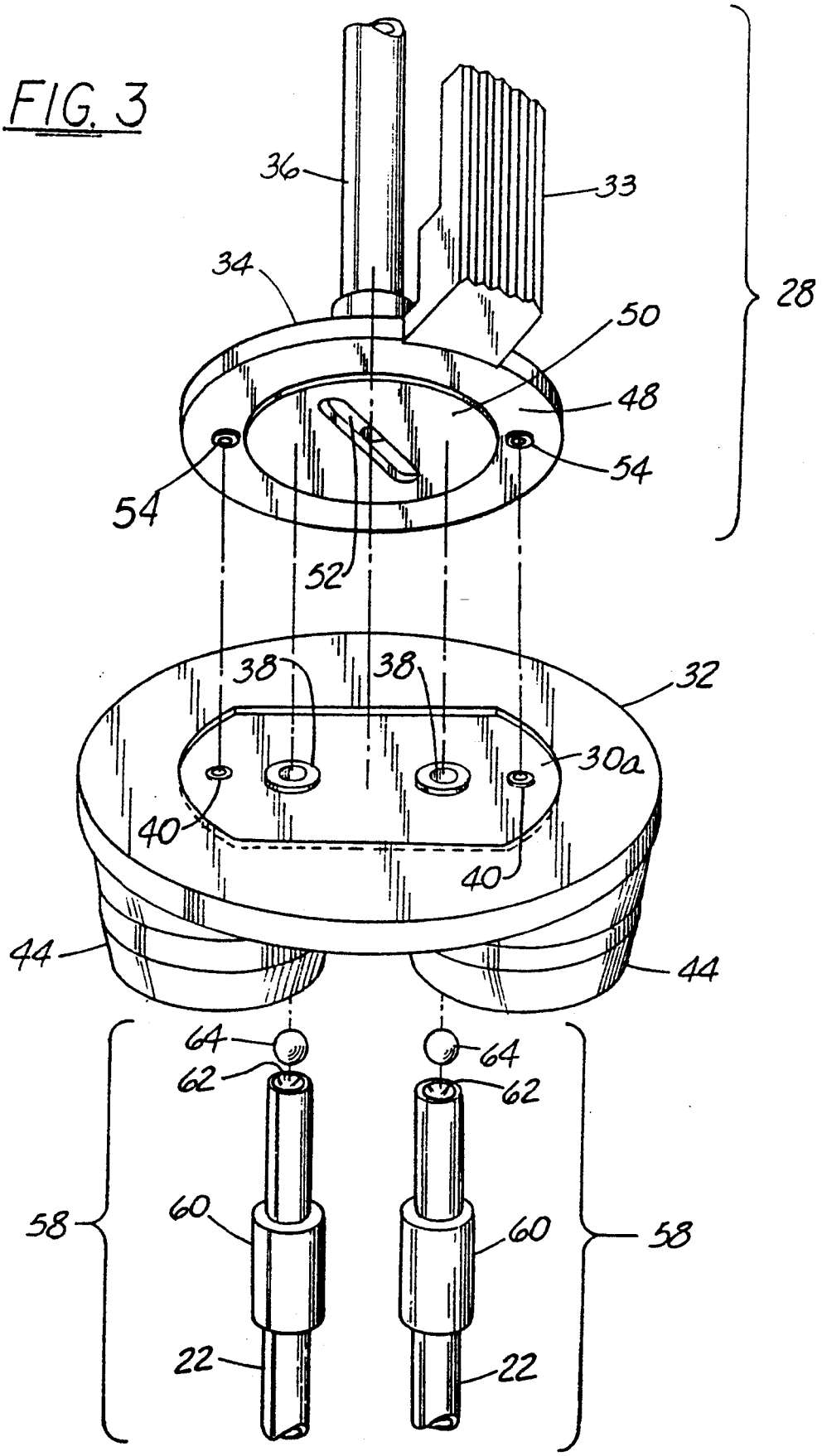
FIG. 3 is an exploded and rotated perspective of the fluid transfer system of the dispensing assembly, showing the dip tubes and vent holes closed off ("covered") by their respective closure means.

FIGS. 2 & 3 show the construction details and different operational positions of fluid transfer system 14.

As FIG. 2 shows, fluid control mechanism 24 is made up of cover structure 26, fluid control structure 28, gasket 30*a*, and plug structure 32. Fluid control structure 28 is made up of switch 33, switch plate 34, and centrally located fluid conduit 36 which, when fluid dispensing assembly 10 is assembled fits into pump 16.

Connected to and extending upwardly from one edge of switch plate 34 is switch 33. When fluid dispensing assembly 10 is assembled, switch 33 extends outwardly through a gap between cover 26 and plug structure 32 and then through an opening in shroud 18. Switch 33 may be moved between a first "on" position and a second "off" position as can be seen in FIG. 1.

Between the lower surface of switch plate 34 and the upper surface of plug structure 32 is positioned gasket 30*a*, which has formed therethrough gasket dip tube openings 38 and gasket vent openings 40. Moving switch 33 moves switch plate 34 relative to gasket 30*a* and plug structure 32, between a first or "uncovered" position and a second or "covered" position as discussed below.

Switch plate 34 has peripheral area 48, and, raised relative to peripheral area 48, central area 50. Formed into central area 50 and lying transverse to fluid conduit 36 is fluid transfer channel 52. Situated upon and raised relative to peripheral area 48 are doughnut-like vent closure structures 54, which are positioned so that they align with plug vent holes 42 when the parts are assembled. When switch plate 34 and plug structure 32 are connected (with gasket 30*a* being positioned between the two), raised central area 50 on switch plate 34 creates peripheral air flow gap 56 between the two. When switch plate 34 is in its "uncovered" or venting position, ambient air enters air flow gap 56 visible in FIG. 5 and flows through aligned gasket vent openings 40 and plug vent openings 42 to vent fluid containers 12.

Figure 5:
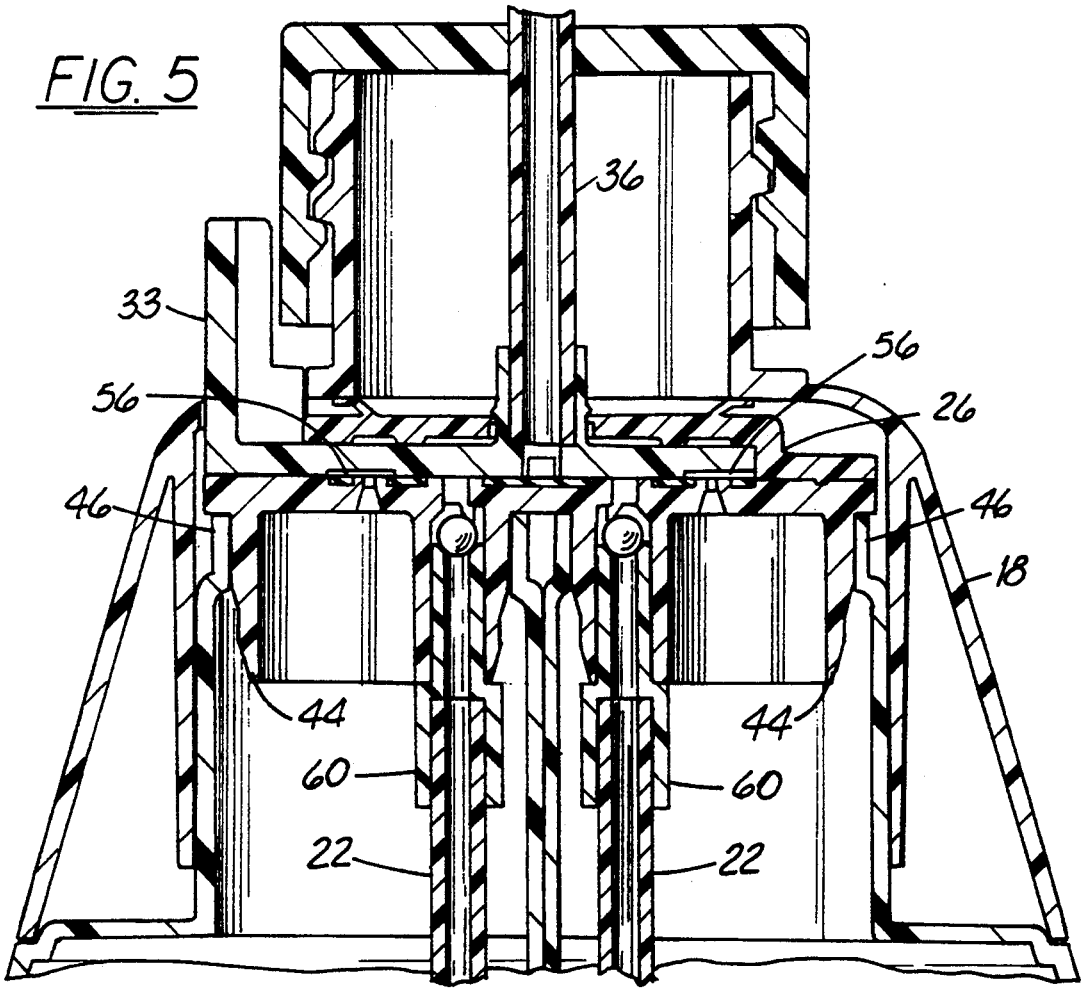
FIG. 5 is a side sectional view of the fluid transfer assembly including parts of the fluid container necks and the assembly shroud showing the components in the "uncovered" configuration.

Plug structure 32 has, formed into its top side, plug dip tube openings 43 and plug vent holes 42. As can be seen in FIG. 5, extending downwardly from the bottom side of plug structure 32 are neck accepting structures 44, which are configured to receive container necks 46 of fluid containers 12.

Located between and serving to join dip tubes 22 and the underside of plug structure 32 are ball check assemblies 58 which are made up of ball check adapters 60 with ball valve seats 62 and balls 64. Balls 64 are positioned between ball valve seats 62 and the underside of plug structure 32 and are freely moveable within.

Ball check assemblies 58 were found to be necessary to prevent siphoning of fluid from one fluid containing container into the other and to minimize drainback of fluid retained in the channels above ball check assemblies 58 and pump 16. Ball check adapters 60 can be eliminated by forming ball valve seats 62 integrally with dip tubes 22 via post forming. However, ball check adapters 60 and balls 64 must be precisely machined in order to assure complete shutoff of fluid flow.

Figure 4:
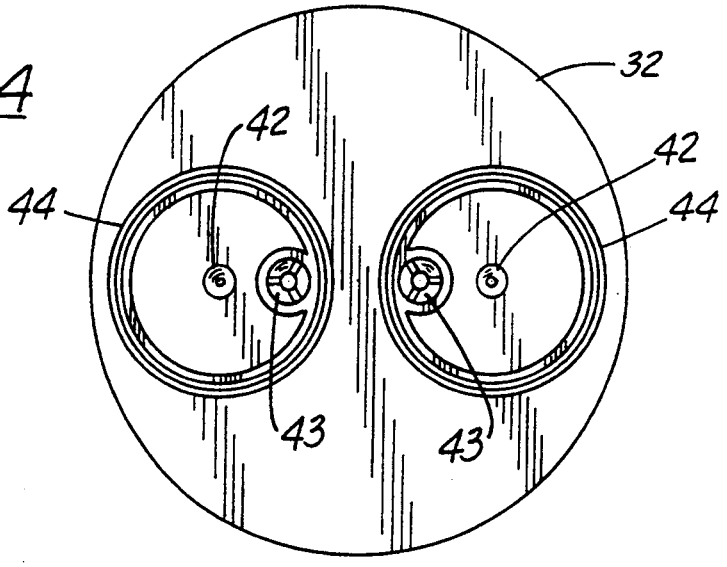
FIG. 4 is a bottom plan view of the plug structure of the fluid transfer system.

As is best seen in FIG. 4, one plug vent hole 42 and the underside of the one dip tube hole 43 are formed into that portion of the top of plug structure 32 that lies within one neck accepting structure 44.

In assembly of fluid transfer system 14, gasket 30*a* is placed on the top of plug structure 32 so that plug vent holes 42 and gasket vent holes 40 are aligned and plug dip tube openings 43 and gasket dip tube openings 38 are aligned.

Switch plate 34 is then positioned over combined gasket 30*a* and plug structure 32 so that fluid transfer channel 52 overlies aligned gasket dip tube openings 38 and plug dip tube openings 43.

Then cover structure 26 is placed on top of switch plate 34. Fluid conduit 36 extends through cover structure 26. Cover structure 26 and plug structure 32 are then fastened together, preferably by sonic welding.

Ball check adapters 60 are affixed at their lower ends to the tops of dip tubes 22 and their top ends are positioned over plug dip tube openings 43.

FIG. 2 shows switch plate 34 and gasket 30*a* in the "uncovered" relative orientation. In this orientation, gasket dip tube openings 38 are aligned with the open ends of ball check adapters 60 and then with dip tubes 22. Gasket dip tube openings 38 are also aligned with fluid transfer channel 52.

In this orientation, vent closure structures 54 are positioned away from combined plug vent openings 42 and gasket vent openings 40. The net effect of these alignments is that all fluid pathways are in open communication: ambient air enters air flow gap 56 and flows into aligned gasket vent openings 40 and plug vent openings 42 and thence into fluid containers 12, and fluid within fluid containers 12 can, by the action of pump 16, be drawn up dip tubes 22, and, assuming balls 64 have been lifted from their seated positions on the top of ball check adapters 60 by the action of pump 16, pass through aligned plug dip tube hole openings 43 and gasket dip tube openings 38, pass through fluid transfer channel 52, and then enter fluid conduit 36, and pass into pump 16. From pump 16, the fluid is propelled out through dispensing outlet 19.

FIG. 3 shows the same elements as FIG. 2, but in different orientation and positions, in the "covered" position. In this figure, switch plate 34 has been rotated so that the solid portion of raised central area 50 aligns with to cover dip tube holes 43 and gasket dip tube openings 38, and vent closure structures 54 align with to close off combined gasket vent holes 40 and plug vent openings 42. In this figure, ball 64 is shown above its resting seated position at the top of ball check adapter 60.

In practice, fluid containers 12 are filled with the desired fluids. Fluid transfer system 14 is connected to fluid containers 12. Shroud 18 is connected to pump 16. The combination of shroud 18 and pump 16 is joined by means of shroud 18 to the combination of fluid transfer system 14 and fluid containers 12. This may be done by the manufacturer of the unit, or by the end user if refill use of the containers is intended.

The user of fluid dispensing assembly 10 must move switch plate 34 to the "uncovered" position and then, by the squeezing of trigger 20 create a pulsed vacuum that will draw fluid up dip tubes 22 from fluid containers 12 through fluid transfer channel 52 and fluid conduit 36 and up into pump 16, from which the fluids are now dispersed from dispensing outlet 19 onto the desired location.

Figure 6:
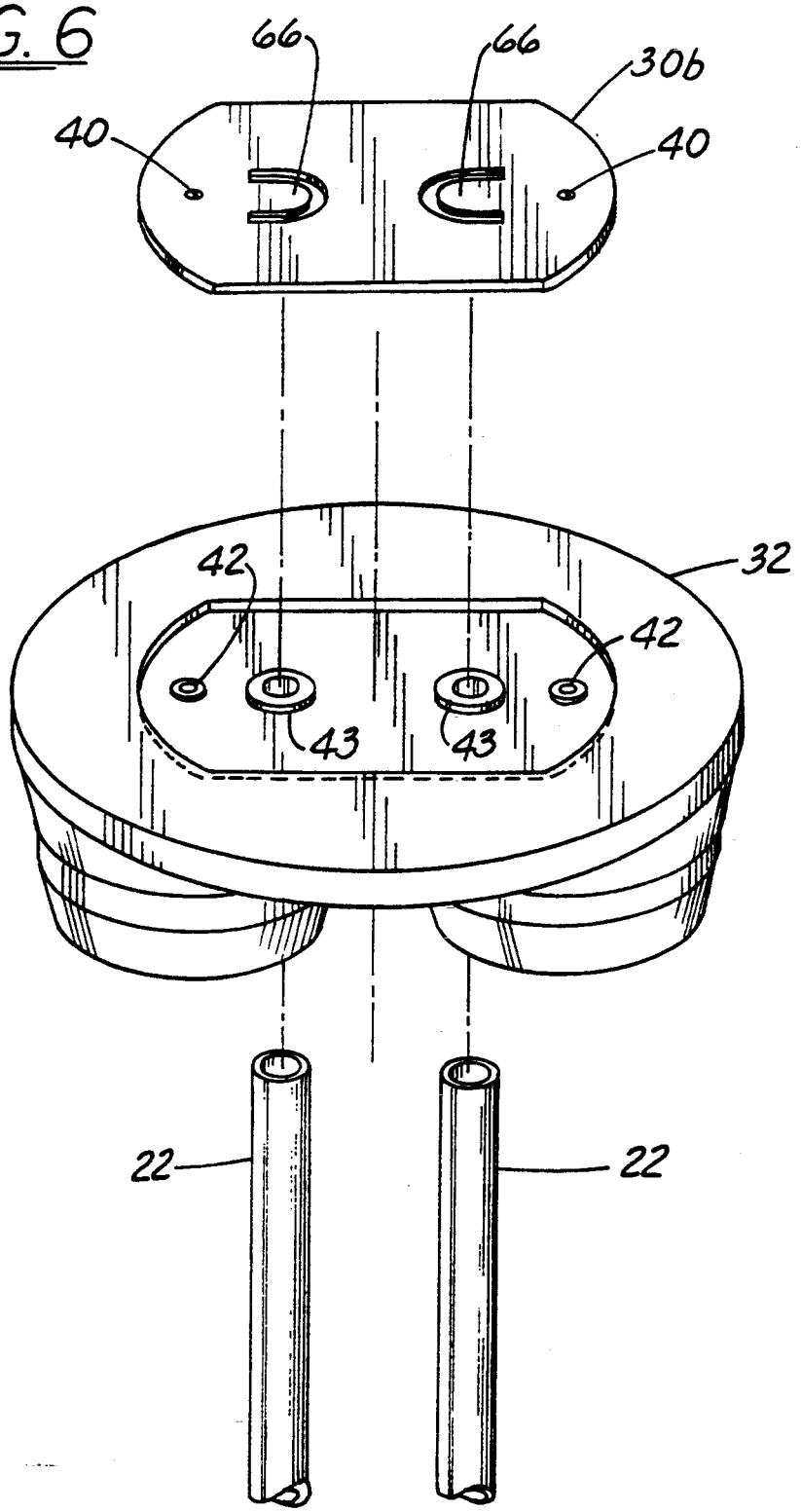
FIG. 6 shows a second embodiment of the dip tube closure means.

FIG. 6 shows another embodiment of the mechanism for the control of fluid passing from containers 12 to pump 16.

In this embodiment, gasket **30*b* has flapper valves 66. In this embodiment, ball check adapters 60 will not exist and dip tubes 22 will be connected directly to the underside of plug structure 32. In response to a negative pressure created by the activation of pump 16 above flapper valves 66, flapper valves 66 will flex upward, allowing fluid to pass up dip tubes 22 into fluid transfer channel 52 and ultimately to be dispersed from dispensing outlet 19**.

Other one-way valving systems such as duck-bill valves, diaphragm valves, needle valves, volume-limited valves, etc., all known to those skilled in the art, may be substituted for the flapper valves, with appropriate modifications of the structure of the fluid transfer system.

A variation of the structure of the present invention, not illustrated but easily visualized by one skilled in the art, would eliminate raised central area 50 and vent closure structures 54 of switch plate 34, thus, in assembly, eliminating air flow gap 56. Instead, venting air would enter the containers 12 through a set of vent holes in cover structures 26 which would be configured so as to be positionable into alignment with gasket vent holes 40 and plug vent holes 42. Other components and functions of this variation would be the same as those previously discussed.

Other modifications of the multiple-component fluid dispensing assembly of the present invention will become apparent to those skilled in the art from an examination of the above patent specification and drawings. Therefore, other variations of the present invention may be made which fall within the scope of the following claims, even though such variations were not specifically discussed above.

INDUSTRIAL APPLICABILITY

The dispensing assembly of the present invention can be used whenever simultaneous dispensing of different and possibly incompatible fluids is desired. For example, one container might hold a liquid cleansing solution and the other a bleach, or one an aqueous stain removing formulation and the other a high solvent, enzyme-containing stain removing formulation. While convenience is a factor in dispensing two liquids from a single assembly, it has been found that the simultaneous dispensing of fluids having different properties and different active ingredients can provide performance superior to that of sequential application of the same fluids.

What we claim is:

1. An apparatus for the simultaneous dispensing of multiple fluids comprising:

at least two fluid containers, each fluid container having a container opening, manually operable pumping means having a pump chamber, a pump fluid passageway and pump actuation means, coupling means for joining the pumping means to the fluid containers, venting means for allowing instantaneous equalization between ambient air pressure and the pressure within each fluid container, means for closing the venting means to prevent fluid from leaking from a fluid container, at least two hollow dip tubes, each dip tube having a top end opening which is in fluid communication with a fluid transfer channel, which is itself in fluid communication with the pumping means, each dip tube having a bottom end, extending into the interior of a respective one of the fluid containers, fluid transfer means for transferring fluid from the fluid containers to the pumping means, the fluid transfer means comprising a fluid transfer structure having a fluid transfer channel which is, along its bottom side, in fluid communication with the open top ends of the dip tubes and along its top side in fluid communication with a fluid conduit which extends into and is itself in fluid communication with the pump chamber of the pumping means, and valving means for opening and closing the dip tubes, in response to actuation of the pumping means, by the pump actuation means, which, when the pumping means is not actuated, produces an interruption in the fluid communication between the fluid transfer channel and the dip tubes.

2. A fluid dispensing apparatus according to claim 1, wherein the fluid transfer structure comprises a cover portion, configured to fit against the base of the pumping means, and having an opening therethrough to accommodate the pump fluid passageway, a bottom plug portion, configured to fit against and connect with the container openings of the fluid containers and having extending therethrough at least two collar container openings into which the top ends of the hollow dip tubes extend, and, located between the cover portion and the plug portion, a switch plate portion, configured so that the fluid transfer channel of the fluid transfer structure is formed therein.

3. A fluid dispensing apparatus according to claim 2, wherein the venting means comprises a switch plate having top and bottom switch plate sides, a gasket, and the bottom plug portion of the fluid transfer structure, which has a top and a bottom plug side, the switch plate having on the top side thereof a fluid conduit structure through which fluid is transferred to the pumping means and, on the bottom side thereof, a peripheral switch plate area, a central switch plate area raised relative to the peripheral area, a closed-ended fluid transfer channel formed into the central switch plate area, the fluid conduit structure opening into the fluid transfer channel, and at least two vent structures formed on and raised relative to the peripheral switch plate area, the bottom plug portion having, extending downward from its bottom plug side, at least two container neck accepting structures, and formed through its top side, at least two dip tube openings and at least two plug vent hole openings, each dip tube opening and each plug vent hole opening being located above a respective container neck accepting structure.

4. A fluid dispensing apparatus according to claim 3, wherein the means for closing the venting means comprises at least two cover vent holes formed through the cover portion of the fluid transfer structure, means for moving the switch plate between a first switch position, in which each cover vent hole is positioned away from a corresponding plug vent hole opening, thus interrupting any fluid communication between and through a respective cover vent hole and a corresponding plug vent hole, and thus preventing fluid from leaking from the fluid containers, and a second venting position, in which each cover vent hole is aligned with a corresponding plug vent hole opening, allowing fluid communication of ambient air through an aligned cover vent hole and a corresponding plug vent hole opening and into a respective fluid container.

5. A fluid dispensing apparatus according to claim 1, wherein the valving means for opening and closing the dip tubes comprises a ball-check assembly attached to the top of each dip tube, each ball-check assembly having a ball housing which connects to the top of a respective dip tube.

6. A fluid dispensing apparatus according to claim 1, wherein the valving means for opening and closing the dip tubes comprises a volume-limited valve assembly attached to each dip tube, each volume-limited valve assembly having a housing which connects to the top of a respective dip tube.

7. A fluid dispensing apparatus according to claim 1, wherein the valving means for opening and closing the dip tubes comprises a deformable member which, in a first valving position interrupts fluid flow from the top ends of the dip tubes, thereby interrupting any fluid communication between the fluid transfer channel and the dip tubes, and, in a second valving position, opens fluid flow from the top ends of the dip tubes, thereby allowing the fluid transfer channel and the dip tubes to be in fluid communication.

8. A fluid dispensing apparatus according to claim 1, wherein the hollow dip tubes are each of a pre-determined internal diameter and length so that, in response to the action of the pumping means, each will deliver to the pumping means a predetermined amount of fluid from the container into which it has been inserted.

9. An apparatus for the simultaneous dispensing of at least two different fluids in a consistent, pre-determined ratio, the apparatus comprising:

two fluid containers, each fluid container having a fluid container neck opening, manually operable trigger activated pumping means having a pump chamber and a pump fluid passageway, coupling means for removably joining the pumping means to the fluid containers, venting means for allowing instantaneous equalization between ambient air pressure and the pressure within each fluid container, means for closing the venting means to prevent fluid from leaking from a fluid container, two hollow dip tubes, each dip tube having a top end opening which is in fluid communication with a fluid transfer channel, which is itself in fluid communication with the pumping means, each dip tube having a bottom end, extending into the interior of a respective one of the fluid containers, fluid transfer means for transferring fluid from at least one of the fluid containers to the pumping means, the fluid transfer means comprising a fluid transfer structure having a fluid transfer channel which is, along its bottom side, in fluid communication with the open top ends of the dip tubes and along its top side in fluid communication with a fluid conduit which extends into and is itself in fluid communication with the pump chamber of the pumping means, and valving means for opening and closing the dip tubes, in response to actuation of the pumping means, which, when the pumping means is not actuated, produces an interruption in the fluid communication between the fluid transfer channel and the dip tubes.

10. A fluid dispensing apparatus according to claim 9, wherein the fluid transfer structure comprises a cover portion, configured to fit against the base of the pumping means, and having an opening therethrough to accommodate the pump fluid passageway, a bottom plug portion, configured to fit against and removably connect with the neck openings of the fluid containers and having at least two collar neck openings extending therethrough into which the top ends of the hollow dip tubes extend, and located between the cover portion and the plug portion, a switch plate portion, configured so that a mixing chamber of the fluid transfer structure is formed therein.

11. A fluid dispensing apparatus according to claim 10, wherein the venting means comprises a switch plate having top and bottom switch plate sides, a gasket, and the bottom plug portion of the fluid transfer structure, which has a top and a bottom plug side, the switch plate having on the top side thereof a fluid conduit structure through which fluid is transferred to the pumping means, and on the bottom side thereof, a peripheral switch plate area, a central switch plate area raised relative to the peripheral area, a closed-ended fluid transfer channel formed into the central switch plate area, the fluid conduit structure opening into the fluid transfer channel, and at-least two vent structures formed on and raised relative to the peripheral switch plate area, the bottom plug portion having extending downward from its bottom plug side, at least two container neck accepting structures and, formed through its top side, at least two dip tube openings and at least two plug vent hole openings, each dip tube opening and each plug vent hole opening being located above a respective container neck accepting structure.

12. A fluid dispensing apparatus according to claim 11, wherein the means for closing the venting means comprises two cover vent holes formed through the cover portion of the fluid transfer structure, means for moving the switch plate between a first switch position, in which each cover vent hole is positioned away from a corresponding plug vent hole opening, interrupting any fluid communication between and through a respective cover vent hole and a corresponding plug vent hole, and thus preventing fluid from leaking from the fluid containers, and a second venting position, in which each cover vent hole is aligned with a corresponding plug vent hole opening, allowing fluid communication of an aligned cover vent hole and a corresponding plug vent hole opening and into a respective fluid container.

13. A fluid dispensing apparatus according to claim 9, wherein the valving means for opening and closing the dip tubes comprises a volume-limited valve assembly attached to each dip tube, each volume-limited valve assembly having a housing which connects to the top of a respective dip tube.

14. A fluid dispensing apparatus according to claim 9, wherein the valving means for opening and closing the dip tubes comprises a ball-check assembly attached to each dip tube, each ball-check assembly having a ball housing which connects to the top of a respective dip tube.

15. A fluid dispensing apparatus according to claim 9, wherein the hollow dip tubes are each of a pre-determined internal diameter and length so that, in response to the action of the pumping means, each will deliver to the pumping means a predetermined amount of fluid from the container into which it has been inserted.

16. A fluid dispensing apparatus according to claim 9, wherein the valving means for opening and closing the dip tubes comprises a volume-limited valve assembly attached to each dip tube, each volume-limited valve assembly having a housing which connects to the top of a respective dip tube.

17. A fluid dispensing apparatus according to claim 9, wherein the valving means for opening and closing the dip tubes comprises a deformable member which, in a first valving position interrupts fluid flow from the top ends of the dip tubes, thereby interrupting any fluid communication between the fluid transfer channel and the dip tubes, and, in a second valving position, opens fluid flow from the top ends of the hollow dip tubes, thereby allowing the fluid transfer channel and the dip tubes to be in fluid communication.

18. An apparatus for the simultaneous dispensing of multiple fluids comprising:

at least two fluid containers, each fluid container having a container opening, manually operable pumping means having a pump chamber, a pump fluid passageway and pump actuation means, coupling means for joining the pumping means to the fluid containers, fluid transfer means for transferring fluid from the fluid containers to the pumping means, the fluid transfer means including a fluid transfer structure having a fluid transfer channel which is, along its bottom side, in fluid communication with the fluid containers and along its top side in fluid communication with a fluid conduit which extends into and is in fluid communication with the pump chamber of the pumping means, venting means for allowing instantaneous equalization between ambient air pressure and the pressure within each fluid container, means for closing the venting means to prevent fluid from leaking from a fluid container, and valving means for allowing and interrupting fluid transfer from the fluid containers to the pumping means by the fluid transfer means, in response to actuation of the pumping means, by the pump actuation means.

19. A fluid dispensing apparatus according to claim 18, further comprising at least two hollow dip tubes, each dip tube having a top end opening which is in fluid communication with the fluid transfer channel of the fluid transfer means, each dip tube having a bottom end, extending into the interior of a respective one of the fluid containers, the fluid transfer channel of the fluid transfer structure, along its bottom side, being in fluid communication with the open top ends of the dip tubes.

20. A fluid dispensing apparatus according to claim 19, wherein the fluid transfer means comprises a cover portion, configured to fit against the base of the pumping means, and having an opening therethrough to accommodate the pump fluid passageway, a bottom plug portion, configured to fit against and connect with the container openings of the fluid containers and having extending therethrough at least two collar container openings into which the top ends of the hollow dip tubes extend, and, located between the cover portion and the plug portion, a switch plate portion, configured so that the fluid transfer channel of the fluid transfer structure is formed therein.

21. A fluid dispensing apparatus according to claim 20, wherein the venting means comprises a switch plate having top and bottom switch plate sides, a gasket, and the bottom plug portion of the fluid transfer structure, which has a top and a bottom plug side, the switch plate having on the top side thereof a fluid conduit structure through which fluid is transferred to the pumping means and, on the bottom side thereof, a peripheral switch plate area, a central switch plate area raised relative to the peripheral area, a closed-ended fluid transfer channel formed into the central switch plate area, the fluid conduit structure opening into the fluid transfer channel, and at least two vent structures formed on and raised relative to the peripheral switch plate area, the bottom plug portion having, extending downward from its bottom plug side, at least two container neck accepting structures, and formed through its top side, at least two dip tube openings and at least two plug vent hole openings, each dip tube opening and each plug vent hole being located above a respective container neck accepting structure.

22. A fluid dispensing apparatus according to claim 21, wherein the means for closing the venting means comprises at least two cover vent holes formed through the cover portion of the fluid transfer structure, means for moving the switch plate between a first switch position, in which each cover vent hole is positioned away from a corresponding plug vent hole opening, thus interrupting any fluid communication between and through a respective cover vent hole and a corresponding plug vent hole, and thus preventing fluid from leaking from the fluid containers, and a second venting position, in which each cover vent hole is aligned with a corresponding plug vent hole opening, allowing fluid communication of ambient air through an aligned cover vent hole and a corresponding plug vent hole opening and into a respective fluid container.

23. A fluid dispensing apparatus according to claim 19, wherein the valving means comprises a ball-check assembly attached to the top of each dip tube, each ball-check assembly having a ball housing which connects to the top of a respective dip tube.

24. A fluid dispensing apparatus according to claim 19, wherein the valving means comprises a volume-limited valve assembly attached to each dip tube, each volume-limited valve assembly having a housing which connects to the top of a respective dip tube.

25. A fluid dispensing apparatus according to claim 19, wherein the valving means comprises a deformable member which, in a first valving position interrupts fluid flow from the top ends of the dip tubes, thereby interrupting any fluid communication between the fluid transfer channel and the dip tubes, and, in a second valving position, opens fluid flow from and the top ends of the hollow dip tubes, thereby allowing the fluid transfer channel and the dip tubes to be in fluid communication.

26. A fluid dispensing apparatus according to claim 19, wherein the hollow dip tubes are each of a predetermined internal diameter and length so that, in response to the action of the pumping means, each will deliver to the pumping means a pre-determined amount of fluid from the container into which it has been inserted.

27. A method of simultaneously dispensing multiple fluids, the method comprising:

providing a multiple container fluid dispensing assembly comprising:

at least two fluid containers, each fluid container having a fluid container opening, manually operable pumping means having a discharge outlet, coupling means for joining the pumping means to the fluid containers, fluid transfer means for transferring fluid from the fluid containers to the pumping means, venting means for allowing instantaneous equalization between ambient air pressure and the pressure within each fluid container, and means for closing the venting means to prevent fluid from leaking from a fluid container, placing fluids in at least two of the fluid containers, inserting dip tubes into the fluid containers, connecting the fluid containers to the pumping means, positioning the means for closing the venting means so that the venting means is in fluid communication with the ambient atmosphere, positioning the fluid transfer means so that the fluid transfer means is in fluid communication with the pumping means, and activating the pumping means to simultaneously dispense multiple fluids from the discharge outlet of the pumping means.

28. A method for the simultaneous dispensing of multiple fluids according to claim 27, wherein, in the providing step, the multiple container dispensing assembly further comprises at least two hollow dip tubes, each dip tube having a top end opening which is in fluid communication with the fluid transfer channel of the fluid transfer means, each dip tube having a bottom end, extending into the interior of a respective one of the fluid containers, the fluid transfer channel of the fluid transfer structure, along its bottom side, being in fluid communication with the open top ends of the dip tubes.

29. A method for the simultaneous dispensing of multiple fluids according to claim 28, wherein in said providing step, the fluid transfer means comprises a cover portion, configured to fit against the base of the pumping means, and having an opening therethrough to accommodate the pump fluid passageway, a bottom plug portion, configured to fit against and removably connect with the neck openings of the fluid containers and having at least two collar neck openings extending therethrough into which the top ends of the hollow dip tubes extend, and located between the cover portion and the plug portion, a switch plate portion, configured so that the fluid transfer channel of the fluid transfer structure is formed thereon.

30. A method for the simultaneous dispensing of multiple fluids according to claim 29, wherein in said providing step, the venting means comprises a switch plate having top and bottom switch plate sides, a gasket, and the bottom plug portion of the fluid transfer structure, which has a top and a bottom plug side, the switch plate having on the top side thereof a fluid conduit structure through which fluid is transferred to the pumping means and, on the bottom side thereof, a peripheral switch plate area, a central switch plate area raised relative to the peripheral area, a closed-ended fluid transfer channel formed into the central switch plate area, the fluid conduit structure opening into the fluid transfer channel, and at least two vent structures formed on and raised relative to the peripheral switch plate area, the bottom plug portion having, extending downward from its bottom plug side, at least two container neck accepting structures and, formed through its top side, at least two dip tube openings and at least two vent hole openings, each dip tube opening and each vent hole being located above a respective container neck accepting structure.

31. A method for the simultaneous dispensing of multiple fluids according to claim 30, wherein in said providing step, the means for closing the venting means comprises at least two cover vent holes formed through the cover portion of the fluid transfer structure, means for moving the switch plate between a first switch position, in which each cover vent hole is positioned away from a corresponding plug vent hole, interrupting any fluid communication between and through a respective cover vent hole and a corresponding plug vent hole, and thus preventing fluid from leaking from the fluid containers, and a second venting position, in which each cover vent hole is aligned with a corresponding plug vent hole opening, allowing fluid communication of ambient air through an aligned cover vent hole and a corresponding plug vent hole opening and into a respective fluid container.

32. A method for the simultaneous dispensing of multiple fluids according to claim 28, wherein in said providing step, the valving means for opening and closing the dip tubes comprises a ball-check assembly attached to the top of each dip tube, each ball-check assembly having a ball housing which connects to the top of a respective dip tube.

33. A method for the simultaneous dispensing of multiple fluids according to claim 28, wherein in said providing step, the valving means for opening and closing the dip tubes comprises a volume-limited valve assembly attached to each dip tube, each volume-limited valve assembly having a housing which connects to the top of a respective dip tube.

34. A method for the simultaneous dispensing of multiple fluids according to claim 28, wherein in said providing step, the valving means for opening and closing the dip tubes comprises a deformable member which, in a first valving position interrupts fluid flow from the top ends of the dip tubes, thereby interrupting any fluid communication between the fluid transfer channel and the dip tubes, and, in a second valving position, opens fluid flow from the top ends of the hollow dip tubes, thereby allowing the fluid transfer channel and the dip tubes to be in fluid communication.

35. A method for the simultaneous dispensing of multiple fluids according to claim 28, wherein in said providing step, the hollow dip tubes are each of a predetermined internal diameter and length so that, in response to activating the pumping means, each will deliver to the pumping means a pre-determined amount of fluid from the container into which it has been inserted.

36. A method of simultaneously dispensing a mixture of fluids in a consistent, pre-determined ratio, the method comprising:

providing a multiple container fluid dispensing assembly comprising:

at least two fluid containers, each fluid container having a fluid container neck opening, manually operable trigger activated pumping means having a pump chamber and a pump fluid passageway, coupling means for removably joining the pumping means to the fluid containers, venting means for allowing instantaneous equalization between ambient air pressure and the pressure within each fluid container, means for closing the venting means to prevent fluid from leaking from a fluid container, two hollow dip tubes, each dip tube having a top end opening which is in fluid communication with a fluid transfer channel, which is itself in fluid communication with the pumping means, each dip tube having a bottom end, extending into the interior of one of the fluid containers, fluid transfer means for transferring fluid from at least one of the fluid containers to the pumping means, the fluid transfer means comprising a fluid transfer structure having a fluid transfer channel which is, along its bottom side, in fluid communication with the open top ends of the dip tubes and along its top side in fluid communication with a fluid conduit which extends into and is itself in fluid communication with the pump chamber of the pumping means, and valving means for opening and closing the dip tubes, in response to actuation of the pumping means, which, when the pumping means is not actuated, produces an interruption in the fluid communication between the fluid transfer channel and the, positioning the means for closing the venting means so that the venting means is in fluid communication with the ambient atmosphere, positioning the fluid transfer means so that the fluid transfer means is in fluid communication with the pumping means, and activating the pumping means to simultaneously dispense a mixture of fluids in a consistent, pre-determined ratio.

37. A method of simultaneously dispensing a mixture of fluids in a consistent, pre-determined ratio according to claim 36, wherein in said providing step, the fluid transfer structure comprises a cover portion, configured to fit against the base of the pumping means, and having an opening therethrough to accommodate the pump fluid passageway, a bottom plug position, configured to fit against and removably connect with the neck openings of the fluid containers and having at least two collar neck openings extending therethrough into which the top ends of the hollow dip tubes extend, and located between the cover portion and the plug portion, a switch plate portion, configured so that fluid transfer channel of the fluid transfer structure is formed thereon.

38. A method of simultaneously dispensing a mixture of fluids in a consistent, pre-determined ratio according to claim 37, wherein in said providing step, the venting means comprises a switch plate having top and bottom switch plate sides, a gasket, and the bottom plug portion of the fluid transfer structure, which has a top and a bottom plug side, the switch plate having on the top side thereof a fluid conduit structure through which fluid is transferred to the pumping means and, on the bottom side thereof, a peripheral switch plate area, a central switch plate area raised relative to the peripheral area, a closed-ended fluid transfer channel formed into the central switch plate area, the fluid conduit structure opening into the fluid transfer channel, and at least two vent structures formed on and raised relative to the peripheral switch plate area, the bottom plug portion having, extending downward from its bottom plug side, at least two container neck accepting structures and, formed through its top side, at least two dip tube openings and at least two vent hole openings, each dip tube opening and each vent hole being located above a respective container neck accepting structure.

39. A method of simultaneously dispensing a mixture of fluids in a consistent, pre-determined ratio according to claim 38, wherein in said providing step, the means for closing the venting means comprises at least two cover vent holes formed through the cover portion of the fluid transfer structure, means for moving the switch plate between a first switch position, in which each cover vent hole is-positioned away from a corresponding plug vent hole, interrupting any fluid communication between and through a respective cover vent hole and a corresponding plug vent hole, and thus preventing fluid from leaking from the fluid containers, and a second venting position, in which each cover vent hole is aligned with a corresponding plug vent hole opening, allowing fluid communication of ambient air through an aligned cover vent hole and a corresponding plug vent hole opening and into a respective fluid container.

40. A method of simultaneously dispensing a mixture of fluids in a consistent, pre-determined ratio according to claim 36, wherein in said providing step, the valving means for opening and closing the dip tubes comprises a ball-check assembly attached to the top of each dip tube, each ball-check assembly having a ball housing which connects to the top of a respective dip tube.

41. A method of simultaneously dispensing a mixture of fluids in a consistent, pre-determined ratio according to claim 36, wherein in said providing step, the valving means for opening and closing the dip tubes comprises a volume-limited valve assembly attached to each dip tube, each volume-limited valve assembly having a housing which connects to the top of a respective dip tube.

42. A method of simultaneously dispensing a mixture of fluids in a consistent, pre-determined ratio according to claim 36, wherein in said providing step, the valving means for opening and closing the dip tubes comprises a deformable member which, in a first valving position interrupts fluid flow from the top ends of the dip tubes, thereby interrupting any fluid communication between the fluid transfer channel and the dip tubes, and, in a second valving position, opens fluid flow from the top ends of the hollow dip tubes, thereby allowing the fluid transfer channel and the dip tubes to be in fluid communication.

43. A method of simultaneously dispensing a mixture of fluids in a consistent, pre-determined ratio according to claim 36, wherein in said providing step, the hollow dip tubes are each of a pre-determined internal diameter and length so that, in response to activating the pumping means, each will deliver to the pumping means a predetermined amount of fluid from the container into which it has been inserted.

44. A method for the simultaneous dispensing of multiple fluids comprising:

providing a multiple container fluid dispensing assembly comprising:

at least two fluid containers, each fluid container having a fluid container opening, manually operable pumping means, coupling means for joining the pumping means to the fluid containers, venting means for allowing instantaneous equalization between ambient air pressure and the pressure within each fluid container, means for closing the venting means to prevent fluid from leaking from a fluid container, two hollow dip tubes, each dip tube having a top end opening which is in fluid communication with a fluid transfer structure, which is itself in fluid communication with the pumping means, each dip tube having a bottom end, extending into the interior of a respective one of the fluid containers, fluid transfer means for transferring fluid from at least one of the fluid containers to the pumping means, the fluid transfer means comprising a fluid transfer structure having a fluid transfer channel which is, along its bottom side, in fluid communication with the open top ends of the dip tubes and along its top side in fluid communication with a fluid conduit which extends into and is itself in fluid communication with the pump chamber of the pumping means, valving means for opening and closing the dip tubes, in response to actuation of the pumping means, which, when the pumping means is not actuated, produces an interruption in the fluid communication between the fluid transfer channel and the dip tubes, placing fluids in at least two of the fluid containers inserting the dip tubes into the fluid containers, connecting the fluid containers to the pumping means, positioning the means for closing the venting means so that the venting means is in fluid communication with the ambient atmosphere, positioning the fluid transfer means so that the fluid transfer means is in fluid communication with the pumping means, and activating the pumping means to dispense multiple fluids from the discharge outlet of the pumping means.

45. A method for the simultaneous dispensing of multiple fluids according to claim 44, wherein in said providing step, the fluid transfer structure comprises a cover portion, configured to fit against the base of the pumping means, and having an opening therethrough to accommodate the pump fluid passageway, a bottom plug portion, configured to fit against and removably connect with the neck openings of the fluid containers and having at least two collar neck openings extending therethrough into which the top ends of the hollow dip tubes extend, and located between the cover portion and the plug portion, a switch plate portion, configured so that the fluid transfer channel of the fluid transfer structure is formed thereon.

46. A method for the simultaneous dispensing of multiple fluids according to claim 45, wherein in said providing step, the venting means comprises a switch plate having top and bottom switch plate sides, a gasket, and the bottom plug portion of the fluid transfer structure, which has a top and a bottom plug side, the switch plate having on the top side thereof a fluid conduit structure through which fluid is transferred to the pumping means and, on the bottom side thereof, a peripheral switch plate area, a central switch plate area raised relative to the peripheral area, a closed-ended fluid transfer channel formed into the central switch plate area, the fluid conduit structure opening into the fluid transfer channel, and at least two vent structures formed on and raised relative to the peripheral switch plate area, the bottom plug portion having, extending downward from its bottom plug side, at least two container neck accepting structures and, formed through its top side, at least two dip tube openings and at least two vent hole openings, each dip tube opening and each vent hole being located above a respective container neck accepting structure.

47. A method for the simultaneous dispensing of multiple fluids according to claim 46, wherein in said providing step, the means for closing the venting means comprises at least two cover vent holes formed through the cover portion of the fluid transfer structure, means for moving the switch plate between a first switch position, in which each cover vent hole is positioned away from a corresponding plug vent hole, interrupting any fluid communication between and through a respective cover vent hole and a corresponding plug vent hole, and thus preventing fluid from leaking from the fluid containers, and a second venting position, in which each cover vent hole is aligned with a corresponding plug vent hole opening, allowing fluid communication of ambient air through an aligned cover vent hole and a corresponding plug vent hole opening and into a respective fluid container.

48. A method for the simultaneous dispensing of multiple fluids according to claim 44, wherein in said providing step, the valving means for opening and closing the dip tubes comprises a ball-check assembly attached to the top of each dip tube, each ball-check assembly having a ball housing which connects to the top of a respective dip tube.

49. A method for the simultaneous dispensing of multiple fluids according to claim 44, wherein in said providing step, the valving means for opening and closing the dip tubes comprises a volume-limited valve assembly attached to each dip tube, each volume-limited valve assembly having a housing which connects to the top of a respective dip tube.

50. A method for the simultaneous dispensing of multiple fluids according to claim 44, wherein in said providing step, the valving means for opening and closing the dip tubes comprises a deformable member which, in a first valving position interrupts fluid flow from the top ends of the dip tubes, thereby interrupting any fluid communication between the fluid transfer channel and the dip tubes, and, in a second valving position, opens fluid flow from the top ends of the hollow dip tubes, thereby allowing the fluid transfer channel and the dip tubes to be in fluid communication.

51. A method for the simultaneous dispensing of multiple fluids according to claim 44, wherein in said providing step, the hollow dip tubes are each of a pre-determined internal diameter and length so that, in response to activating the pumping means, each will deliver to the pumping means a predetermined amount of fluid from the container into which it has been inserted.

* * * * *